United States Patent [19]

Scherbing

[11] 4,325,238

[45] Apr. 20, 1982

[54] CABLE LOCK

[75] Inventor: Frank J. Scherbing, River Grove, Ill.

[73] Assignee: Fort Lock Corporation, River Grove, Ill.

[21] Appl. No.: 159,803

[22] Filed: Jun. 16, 1980

[51] Int. Cl.[3] ..... E05B 73/00

[52] U.S. Cl. ..... 70/18; 70/49

[58] Field of Search ..... 70/15, 18, 30, 49, 93, 70/260, 259

[56] References Cited

U.S. PATENT DOCUMENTS 1,681,409 6/1978 Johnson ..... 70/49

*Primary Examiner*—Robert L. Wolfe

*Attorney, Agent, or Firm*—Leydig, Voit, Osann, Mayer & Holt, Ltd.

[57] ABSTRACT

A cable lock having an elongated lock body secured to one end of the cable with a transverse cable receiving bore passing completely through the lock body and a key-actuated plug carried by the body with first securement means associated with the transverse cable receiving bore. The opposite end of the cable has a lug end engagement member adapted to be received in the transverse bore and means for interlocking engagement with the key plug engagement means upon rotation of a key in the plug to secure the cable to the lock body. A plurality of spaced lug engagement members carried by the cable likewise have securement means to be interlocked with the cable body such that the cable can be locked to the body in a plurality of positions to provide varying size loops of cable used for securement of bicycles, motorcycles and the like.

4 Claims, 14 Drawing Figures

Fig. 1.
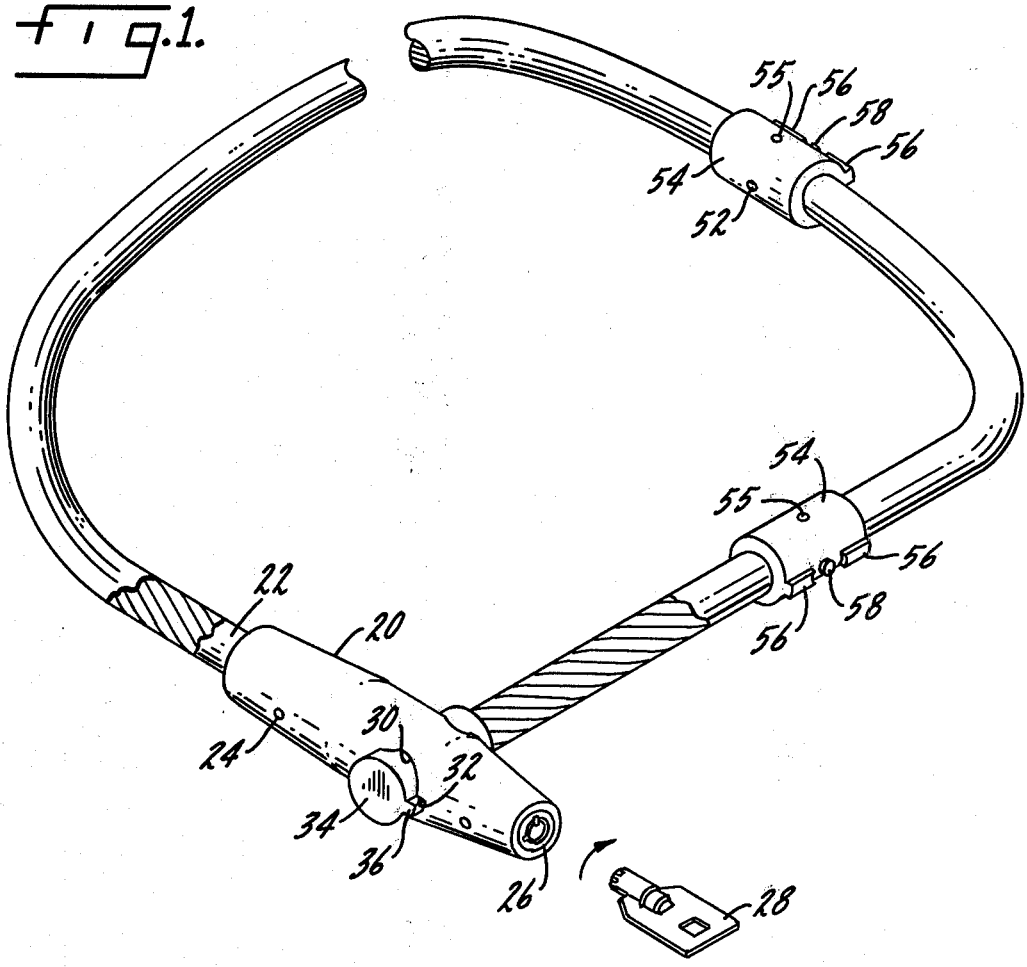
Fig. 2.
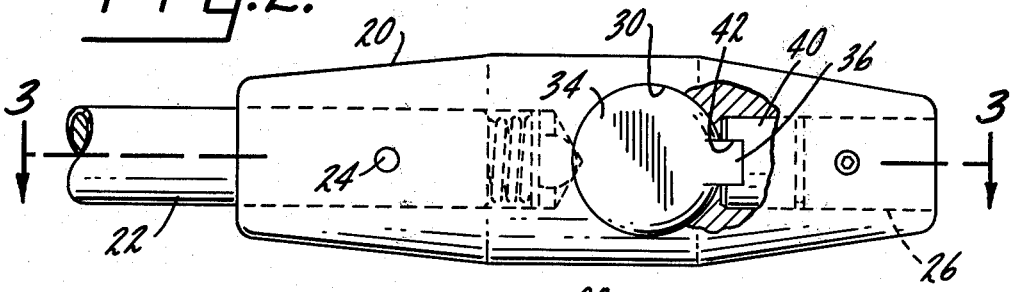
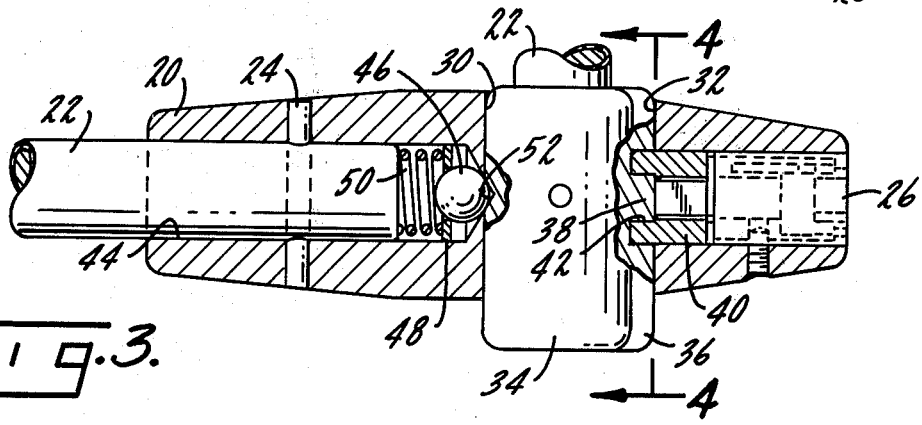
Fig. 3.

Fig. 5.
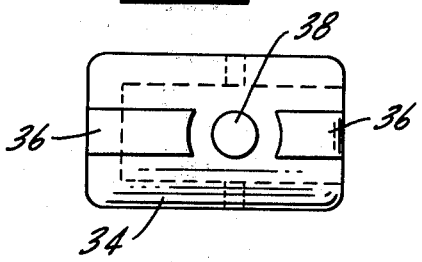
Fig. 6.
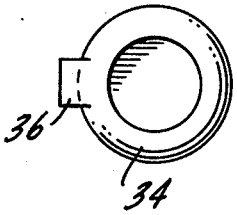
Fig. 7.
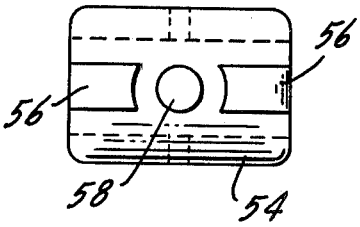
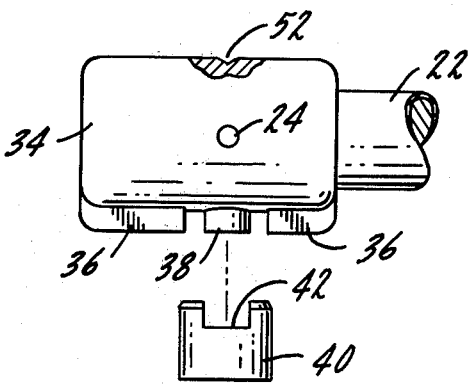
Fig. 8.
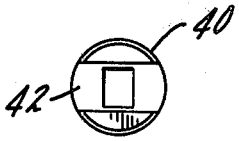
Fig. 9.
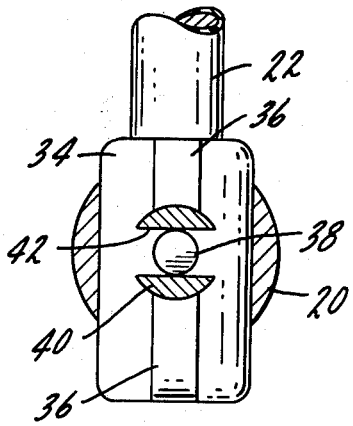
Fig. 4.
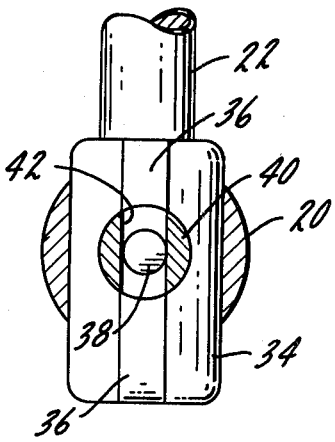
Fig. 4a.

CABLE LOCK

FIELD OF THE INVENTION

The present invention relates generally to cable locks and more particularly to improved cable locks useful for securing bicycles, motorcycles and the like.

BACKGROUND OF THE INVENTION

The unitized structure of a cable lock has become widely accepted as an alternative to the use of a chain and padlock for securement of bicycles, motorcycles and the like. Typically, a cable lock includes a lock body fixedly secured to one end of a cable and the other end of the cable includes a securement member that can be received in a bore in the lock body. A key operated lock mechanism typically holds and releases the securement member so that the cable can be threaded and wrapped around and through wheels, frame and some fixed object. Illustrative examples of cable locks may be seen in U.S. Pat. Nos. 3,855,824 and 4,075,878.

Due to the fact that a wide variety of situations are encountered when using a cable lock, there are no standards of cable length so manufacturers usually offer their cable locks with cable lengths, for example, from three to six feet which is purely arbitrary. The user then is confronted with manipulating the wrapping and threading of the cable by trial and error to come out with the free end meeting and being insertable into the lock body. In the case of bicycles and motorcycles which are not free standing it is often desirable to secure them with the cable lock in a way that they won't fall or be tipped over.

Accordingly, a primary object of the invention is to provide a cable lock that permits the cable to be locked to the body in a plurality of positions to provide varying size loops of cable or to take up slack for more positively securing a vehicle to a fixed object.

Another object is to provide such a cable lock which is convenient to use, relatively low in cost and more widely adaptable to a variety of securement situations.

A BRIEF DESCRIPTION OF THE DRAWINGS

These and other objects of the invention will become apparent from a description thereof which is to be read in conjunction with the following drawings depicting illustrative cable locks according to the invention.

FIG. 1 is a view in perspective generally showing a cable lock embodying the present invention with only a fragmentary portion of the flexible cable being shown;

FIG. 2 is an enlarged side plan view of the lock body in FIG. 1, partly in section;

FIG. 3 is a sectional view taken substantially in the plane of line 3—3 in FIG. 2;

FIG. 4 is a sectional view taken substantially in the plane of line 4—4 in FIG. 3 showing the locked position of the components;

Figure 10:
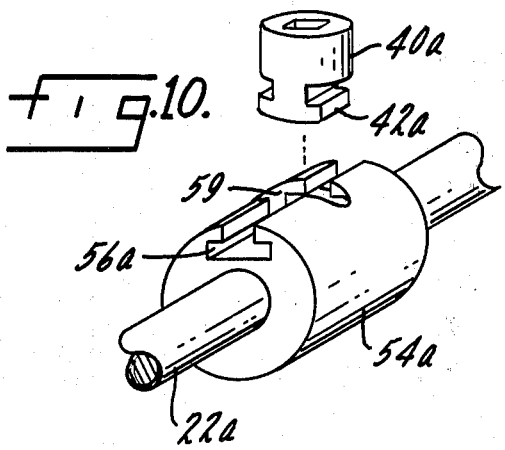
Figure 11:
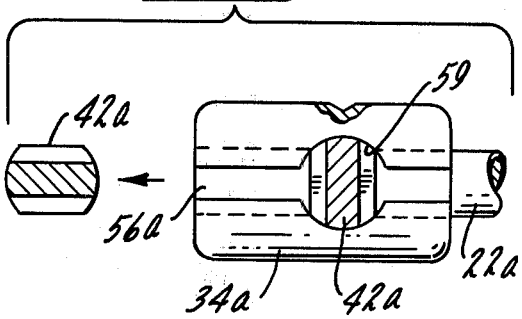
Figure 12:
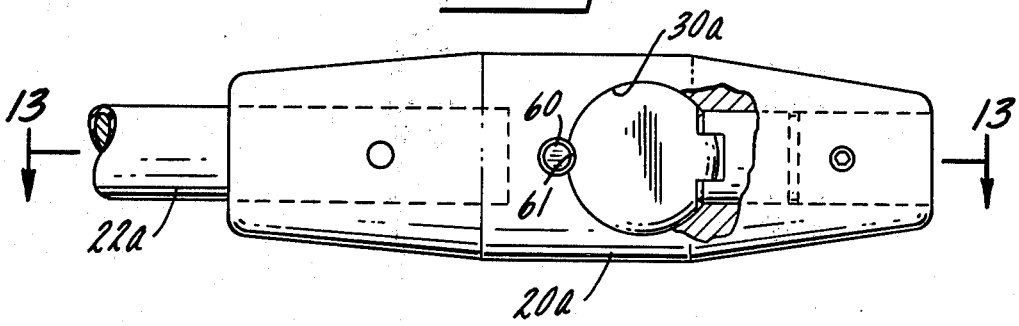
Figure 13:
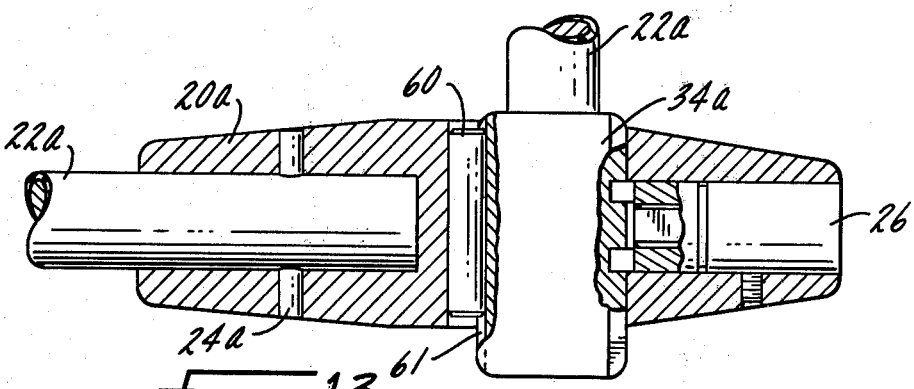

FIG. 4*a* is a view similar to that of FIG. 4 here showing the unlocked position of the components;

FIG. 5 is a plan view of a cable end lug securement member;

FIG. 6 is an end view of the member of FIG. 5;

FIG. 7 is a side view of the cable sleeve lug engagement member;

FIG. 8 is a side view partly fragmentary and exploded showing a locking engagement arrangement;

FIG. 9 is an end view of the key actuated lock engagement member;

FIG. 10 is a perspective exploded view illustrating an alternative engagement arrangement;

FIG. 11 is a diagramatic illustration of the locking engagement by the arrangement in FIG. 10;

FIG. 12 is an enlarged side view of a housing similar to FIG. 2, but here showing an alternative securement; and FIG. 13 is a sectional view taken substantially along the line 13—13 in FIG. 12.

SUMMARY OF THE INVENTION

Briefly, in accordance with the invention, there is provided a cable lock comprising a flexible cable with one of its ends secured to an elongated lock housing carrying a key actuated lock mechanism engagable by a key at its end. The lock housing has a transverse bore though which the cable can completely pass. A plurality of spaced lug engagement members are secured to the cable such that any of the lugs can be positioned within the lock housing and secured to the lock housing by actuation of the key operated lock mechanism.

While the invention will be described in connection with certain preferred embodiments, it will be understood that it is not intended to limit the invention to those embodiments. On the contrary, it is intended to cover all alternatives, modifications and equivalents as may be included within the spirit and scope of the invention.

DETAILED DESCRIPTION

Turning to the figures, there is shown, in FIG. 1, a typical cable lock device incorporating the present invention, the lock here being an elongated housing 20 fixedly secured to one end of a flexible cable 22 by a wedged pin 24 or the like.

The flexible cable 22 which may be desirably made of braided steel wire and encased with a resilient plastic material can be of any desired diameter suitable for the type of use to which the cable lock is put, however, it will be apparent that as larger diameters are selected the more flexibility is diminished and the ability to make small loops becomes impaired.

In the present instance, the locking mechanism generally indicated at 26 is of the axial pin tumbler type using a tubular key 28 since it provides a rugged lock of high security and the axial orientation of the pins, the annular key way and other factors make the lock hard to pick or otherwise open by unauthorized means. Locks of this general type are illustrated in U.S. Pat. Nos. 3,041,086 and 3,509,748. It will be understood, however, as the discussion proceeds that the present invention is not limited to use with axial pin tumbler type locking mechanisms but other types of key operated locks may be used if desired.

In accordance with the present invention, the lock housing 20 has a transverse bore 30 passing completely through the housing as may be seen in FIGS. 1 and 3. The bore also includes a generally square key way 32. The opposite end of the cable 22 has a first cylindrical end lug engagement member 34 adapted to be received in the bore 30. A raised rib means 36 extending longitudinally on the lug 34 is arranged thereon to mate with the key way 32. As best shown in FIG. 5, the rib 36 is interupted intermediate its ends and a cylindrical protuberance 38 is formed in the gap.

Referring to FIG. 3, the locking mechanism 26 carries a rotatable plug 40 which has a transverse slotted end 42. The arrangement is such that when the proper key is inserted into the lock 26 and rotated the plug 40 may be rotated such that the slot 42 is longitudinally aligned with the axis of the bore 30 or transverse to the axis of the bore 30 of housing 20, as illustrated in FIG. 4a and FIG. 4, respectively. Thus, the lug engagement member 34 is simply held or released by rotation of the key 28 inserted into the lock 26 and since the bore 30 passes completely through the lock housing 20, the lug member 34 can be totally removed from the housing or passed through to shorten the cable loop.

Since the lug member 34 can pass completely through the bore 30, provision may be made to positively locate and indicate when the lug 34 is in position for securement by rotation of the key. To this end, referring to FIG. 3, the cable receiving bore 44 in housing 20 has been drilled to open slightly to the cross bore 30 and there is disposed between the cable end and the smaller diameter opening at the bore 30 a captive ball 46 held by a washer 48 and spring 50. The lug 34 has a small depression 52 against which the ball 46 may act. The arrangement is such that a small portion of the ball 46 will protrude into the bore 30 and the ball upon insertion of the lug 34 will be depressed until it meets the depression 52 which provides a detent locating the lug 34 and indicating that the lock mechanism may be rotated to captively confine the lug 34 within the bore 30.

In keeping with the present invention, provision is made for enabling the housing to be locked to the cable at a plurality of positions in addition to the end lug engagement member 34. Thus, referring to FIGS. 1 and 7, conjointly, there is provided a plurality (here two being shown) of cylindrical sleeve type lug engagement members 54 fixedly pinned to the cable 22 by pins 55 at predetermined spaced apart positions. Each of the sleeve lugs 54 likewise has an interupted rib 56 and protuberance 58 as well as a detent depression 52 so that the lock housing 20 can be positioned and locked to any one of the sleeve lugs as may be desired. Referring now to FIGS. 10–13, there is shown a slightly modified version of the present cable lock invention particularly in the area of the manner of securement between the lock housing and lugs. Thus, in the present case, the lugs 34a and 54a are provided with a longitudinally extending T-shaped slot 56a with a cylindrical shaped cavity 59 intermediate the lug ends. The locking mechanism rotatable plug 40a has a corresponding T-shaped end 42a which can captively ride through the slot 56a. When the plug 40a is aligned with the cavity 59 the key actuation can rotate the plug 40a turning the T-shaped end 42a transversely as depicted in FIG. 11 to securely lock the lug to the lock housing 20a.

In order to provide a more positive guide for the lugs to be inserted and passed through the housing 20a, a pin 60 may be set to protrude within the housing bore 30a and a slight recess 61 in the lugs acts as a positive key way.

I claim as my invention:

1. A cable lock, comprising an elongated lock body, said body being secured to one end of a flexible cable, said lock body including a key actuated lock mechanism, a transverse cable receiving bore passing completely through said body, said lock mechanism carrying a first securement means rotatable by actuation of a proper key and in communication with the transverse cable receiving bore, the opposite end of the cable having a lug engagement member connected thereto and adapted to be moved into and through the transverse bore of said body, said lug engagement member having cooperating means for interlocking engagement with the lock mechanism securement means for securement to the cable body upon rotation of a proper key, said cable having a plurality of lug engagement members secured thereto at predetermined spaced intervals, each of said lug members having corresponding engagement means for interlocking with said key actuated engagement means upon rotation of a proper key, and said bore and said lugs each having a corresponding longitudinally extending key and keyway for positively guiding the lugs in said bore.

2. A cable lock comprising an elongated lock body, said body being secured to one end of a flexible cable, said lock body including a key actuated lock mechanism, a transverse cable receiving bore passing completely through said body, said lock mechanism carrying a first securement means rotatable by actuation of a proper key and in communication with the transverse cable receiving bore, the opposite end of the cable having a lug engagement member connected thereto and adapted to be moved into and through the transverse bore of said body, said lug engagement member having cooperating means for interlocking engagement with the lock mechanism securement means for securement to the cable body upon rotation of a proper key, and said body and said lug engagement member including corresponding detent means for indicating the proper position of said lug member within the transverse bore of said body in alignment for rotation of the lock mechanism securement means by the proper key to captively confine said lug within the bore.

3. A cable lock as claimed in claim 2 wherein said detent means includes a spring biased ball carried by the lock body.

4. A cable lock comprising an elongated lock body, said body being secured to one end of a flexible cable, said lock body including a key actuated lock mechanism, a transverse cable receiving bore passing completely through said body, said lock mechanism carrying a first securement means rotatable by actuation of a proper key and in communication with the transverse cable receiving bore, the opposite end of the cable having a lug engagement member connected thereto and adapted to be moved into and through the transverse bore of said body, said cable having a plurality of lug engagement members secured thereto at predetermined spaced intervals, each of said lug engagement members having cooperating means for interlocking engagement with the lock mechanism securement means for securement to the cable body upon rotation of a proper key, said lug member engagement means being T-shaped slots having cylindrical recesses intermediate their ends and said key actuated engagement means being a corresponding T-shaped plug.

* * * * *